United States Patent [19]

Ladd, Jr.

[11] Patent Number: 4,728,211

[45] **Date of Patent: * Mar. 1, 1988**

[54] COSMETIC POWDER DISPENSER AND APPLICATOR

[75] Inventor: James E. Ladd, Jr., Rowayton, Conn.

[73] Assignee: Laura Lupton, Inc., Rowayton, Conn.

[ * ] Notice: The portion of the term of this patent subsequent to Dec. 23, 2003 has been disclaimed.

[21] Appl. No.: 902,767

[22] Filed: Sep. 2, 1986

Related U.S. Application Data

[63] Continuation-in-part of Ser. No. 752,133, Jul. 5, 1986, Pat. No. 4,626,119.

[51] Int. Cl.[4] ..... A46B 11/00

[52] U.S. Cl. ..... 401/123; 132/88.7

[58] Field of Search ..... 401/123; 132/85, 85.5, 132/88.7

[56] References Cited

U.S. PATENT DOCUMENTS

| | | | |
|---|---|---|---|
| 1,571,556 | 2/1926 | Nyhagen | 401/125 |
| 2,743,042 | 4/1956 | Burgin | 401/283 |
| 2,796,070 | 6/1957 | Marsar | 132/85 |
| 4,579,133 | 4/1986 | Scidler | 132/85 |
| 4,626,119 | 12/1986 | Ladd, Jr. | 401/123 |
| 4,630,954 | 12/1986 | Ladd, Jr. | 401/123 |
| 4,630,955 | 12/1986 | Ladd, Jr. | 401/123 |

*Primary Examiner*—Gregory E. McNeill

[57] ABSTRACT

First, second and third elongated members are disposed along a common line of elongation. The first member has a first closed end having a centrally disposed curved outer surface of circular shape with a first group of openings and a second open end. The second member has a third closed end and a fourth open end. The third end has a recessed outer surface of circular shape containing a second like group of openings and a third group of openings spaced from the curved circular surface. The third member has a fifth open end and a sixth closed end. The first end of the first member is snap fitted and rotatably disposed in the third end of the second member. The two curved surfaces are in mating engagement. Depending upon the position of relative rotation, the second group of openings can be aligned with or out of alignment with the first group of openings. The fifth end of the third member detachably engages the fourth end of the second member. A brush containing bristles is disposed in the third member and is slidably movable back and forth along the line of elongation when the third member is detached from the second member. A hollow elongated capsule open at one end and closed at the other is adapted to be filled with cosmetic powder and to be slidably disposed in the first member. When so disposed, the open end of the capsule is adjacent the second end of the first member.

5 Claims, 5 Drawing Figures

COSMETIC POWDER DISPENSER AND APPLICATOR

CROSS REFERENCE TO COPENDING APPLICATION

This application is a continuation-in-part of copending application having the same title, Ser. No. 752,133, filed July 5, 1986, now U.S. Pat. No. 4,626,119.

BACKGROUND OF THE INVENTION

The copending application discloses a cosmetic dispenser and applicator which employs a first elongated hollow member having first and second opposite ends. The first end is open; the second end is closed and has a plurality of small spaced openings therein. A hollow elongated capsule adapted to be filled with cosmetic powder is removably slidable into and out of the first member. The capsule, when inserted into the first member, has its open end adjacent the second end of the first member and its closed end closing the first end of the second member.

A second elongated hollow member has a first end with a like plurality of like openings and a second open end, the second member rotatably engaging the first member with the first end of the second member adjacent the second end of the first member. The first and second members have a first position of relative rotation at which the openings in the two members are aligned and a second position of relative rotation at which the openings in the two members are out of alignment.

A third elongated hollow member has an open end detachably engaging the second end of the second member and has an opposite closed end. A brush has a plurality of essentially paralled bristles with powder applying tips. The brush is disposed in the third member with tips adjacent the second member. The brush and third member have manually operated cooperating elements for establishing a first forward position at which the bristles extend almost entirely out of the third member and a second withdrawn position at which the brush is disposed within the third member.

In use, the dispenser and applicator is disposed vertically with the first member disposed above the second member and the brush is disposed within the third member. The first and second members are then placed in the first position of relative rotation whereby, when the capsule contains powder, the powder flows downwardly through the aligned holes onto the tips of the bristles. When sufficient powder has been applied to the tips, the two members are placed into the second position of relative rotation whereby the flow of powder ceases. The third member is then detached from the second member and the brush is moved into the forward position with respect to the third member. By using the third member as a handle, the user can apply the powder as needed.

The cosmetic powder dispenser and applicator disclosed in the copending application requires parts that are manufactured to very close tolerances and require skilled assemblers, whereby manufacturing costs are high. The present invention discloses a cosmetic powder dispenser and applicator of the same type and operating in the same way which incorporates certain modifications which enables the use of parts manufactured to less close tolerances and use of unskilled assemblers.

SUMMARY OF THE INVENTION

In accordance with the principles of this invention, a cosmetic powder dispenser and applicator comprises a first elongated member having a first closed end and an open second end. The second end has a centrally disposed curved outer surface of circular shape with a first group of small spaced openings therein which communicate with the interior of the first member.

A hollow elongated capsule adapted to be filled with cosmetic powder is closed at one end and open at the other. The capsule is removably slidable into and out of the first member. When the capsule is inserted into the first member, the open end of the capsule is disposed adjacent the second end of the first member and the closed capsule end closes the first end of the first member.

A second elongated member has a closed third end and an open fourth end. The third end has a centrally disposed curved outer surface of circular shape with a second group of openings and also has a third group of openings spaced from the curved circular surface. The second and third groups of openings communicate with the interior of the second member. The first and second groups each contain like pluralities of like openings.

One of the second and third ends has a flush outer surface while the other of the second and third ends has a recessed outer surface. The end having the flush surface snap fits within the end having the recessed surface in a connection at which these surfaces are in conforming mating engagement. One of these two ends adjacent the corresponding second or third end has a plurality of spaced circular rings while the other of these two ends adjacent the corresponding third or second end has a like plurality of spaced circular grooves each of which is engaged rotatably by the corresponding circular ring whereby either one of the first and second members can be rotated with respect to the other. The first and second members have a first position of relative rotation at which the openings in the first and second groups are aligned and a second position of relative rotation at which the openings in the first and second groups are out of alignment.

A third elongated hollow member has a fifth open end detachably engaging the fourth end and has an oppositely disposed sixth closed end. A brush having a plurality of essentially parallel bristles with powder applying tips is disposed in the third member. When the third member is detached from the second member, the brush is manually slidable in the third member back and forth along a line parallel to the direction of elongation of the third member.

This dispenser and applicator can be operated and used in the same manner as the dispenser and applicator disclosed in the copending application. However, the dispenser and applicator so disclosed utilized flat abutting surfaces in the first and second members. When the very close tolerances specified for these two parts were not met, assembly of such parts could produce conditions under which powder could be caught and stored between the two surfaces or could be expelled without flowing onto the bristle tips during the powder dispensing operation whereby clogging and improper dispensing conditions could ensue.

The use of the conforming curved surfaces in the cosmetic powder dispenser and applicator disclosed herein enables use of low tolerance parts which yet mate in such manner that powder cannot be caught and stored between these two surfaces. In addition, the use of the third group of openings prevents powder from being expelled without flowing onto the bristle tips during the powder dispensing operation. Finally, the dispenser and applicator disclosed in the copending application employs a lip on one of the first and second members which engages a groove on the other of these members to establish the desired condition of relative rotation. When the desired tolerances are not satisfied, the rotation relationship can be unsatisfactory. The use of multiple rings and multiple grooves in which the rings are rotatably disposed employed in the present invention overcomes this problem.

DETAILED DESCRIPTION OF PREFERRED EMBODIMENTS

Figure 1:
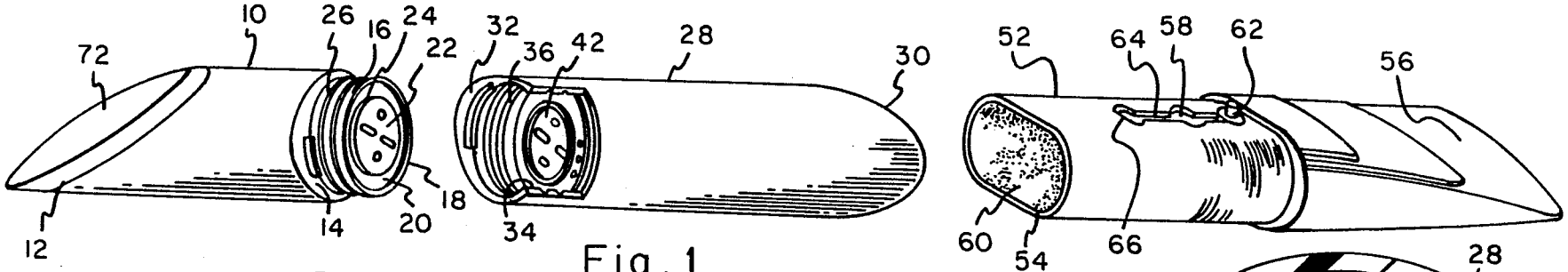
FIG. 1 is an exploded view of an embodiment of the present invention.
Figure 3:
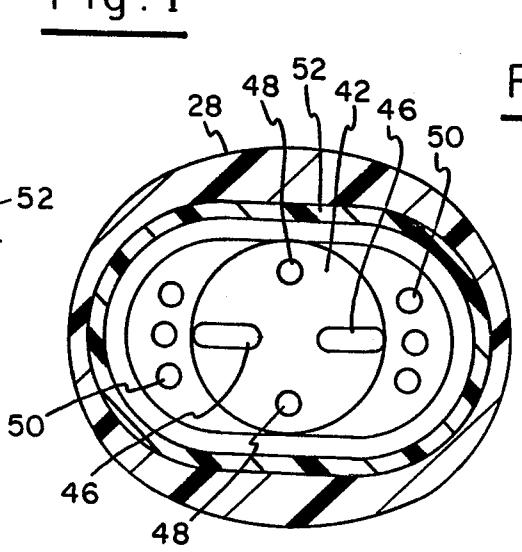
FIG. 3 is a view taken along line 3—3 in FIG. 2.
Figure 2:
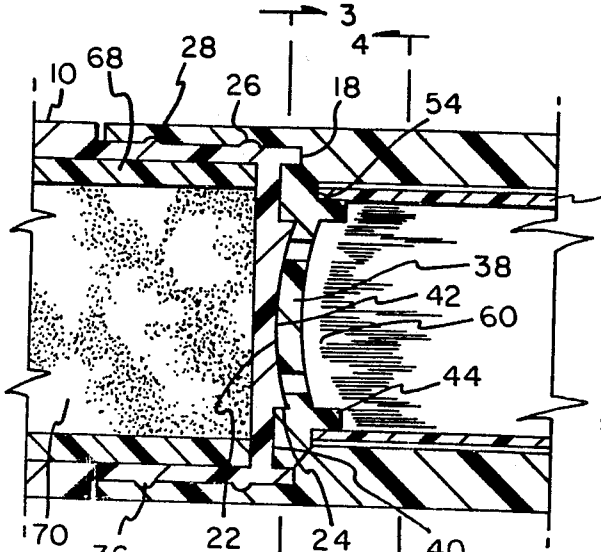
FIG. 2 is a detail cross sectional view showing the curved mating surfaces in mating relationship.

Referring first to FIGS. 1, 2 and 3, there is shown a first elongated hollow plastic member 10 having an elliptically shaped cross section. Member 10 has an open end 12 which lies in a plane disposed at an acute angle with respect to the direction of elongation. Member 10 has a shoulder 14 intermediate its end and a hollow cylindrical extension 16 of circular cross section which terminates in a closed surface 20 disposed at right angles to the direction of elongation which contains a peripheral lip 18 spaced from an externally curved concave surface section 22 which is disposed forwardly of surface 20 with an exposed peripheral edge 24. The outer cylindrical surface of extension 16 has spaced peripheral circular rings 26.

A second hollow plastic member 28 also has a like elliptically shaped cross section. One end 30 is open. The other end 32 has a recess in the shape of a circular hollow cylinder 34 carrying a plurality of spaced circular grooves 36. The recess communicates with a thin disc 38 disposed at right angles to the line of elongation and separating the recess from the hollow interior of the body of member 28. The disc has the same elliptical shape as this interior. The disc has on its outer surface a raised circular lip 40 containing a centrally disposed circular region 42 having an externally curved convex surface. The disc has on its inner surface an elliptically shaped lip 44 spaced inwardly from the inner wall of member 28.

Extension 16 snap fits into the recess with the rings 26 engaging grooves 36 so that member 10 and member 28 can be rotated relative to each other. Lip 38 engages the surface 20 between lip 18 and edge 24 whereby section 22 and region 42 are locked into conforming mating engagement.

Section 22 is provided with two spaced elongated openings 46 which fall along a horizontal common line. As previously indicated, member 10 has an elliptical cross section with major and minor axes. Member 28 also has major and minor axes in cross section. These two major axes are aligned as are the two minor axes. As shown most clearly in FIG. 3, the horizontal line of the openings 46 is coincident with the aligned major axes. Section 22 also has two circular openings 48 which fall along a vertical common line coincident with the minor axes.

Figure 4A:
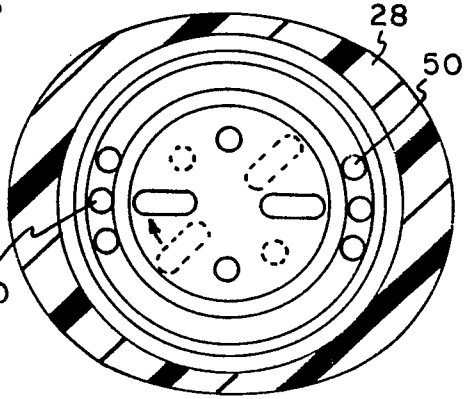
FIG. 4A is a view taken along line 4—4 when the openings in the first and second groups of openings are out of alignment.
Figure 4B:
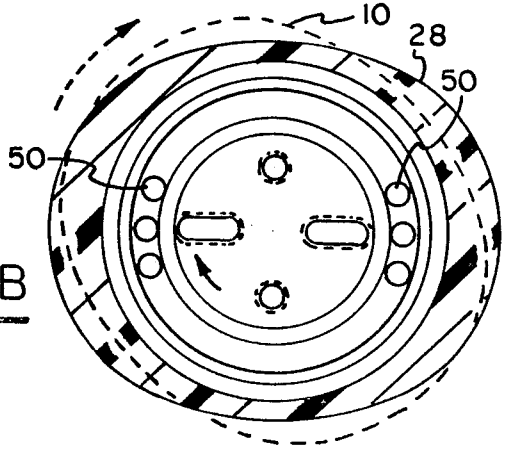
FIG. 4B is a view taken along line 4—4 when the openings in the first and second groups of openings are out of alignment.

Region 42 has like openings 46 and 48. As shown in FIG. 4A, the openings in section 22 can be out of alignment with the openings in region 42 when the members 10 and 28 have been rotated relative to each other until their outer surfaces are aligned, or as shown in FIG. 4B, these openings can be aligned with each other when the members 10 and 28 have been rotated until their outer surfaces are substantially out of alignment. Disc 38 also has spaced openings 50 which are disposed therein between lip 44 and region 42 and are disposed on opposite sides of region 42 in the neighborhood of the minor axes.

An elongated plastic member 52 also of elliptical cross section has an open end 54 and an opposite closed end 56. A brush 58 has bristles with tips 60 and has a spring loaded button 62 extending upwards in a longitudinally extending slot 64 in member 22. The slot has enlarged regions 66 which can accommodate the button. When member 52 is separated from the member 28, the button can be depressed and the brush slid back and forth in the slot. Normally, the brush is in the position shown in FIG. 1 and the member is slid into the open end 30 of member 28 and slid forward therein until the end 54 engages the space between lip 44 and the inner wall of member 28. This arrangement brings the tips of the bristles into approximate engagement with the rear surface of disc 38.

A hollow plastic capsule 68 can be filled with cosmetic powder 70 and slidably and removably inserted into member 10 via its open end. The capsule has a closed transparent end 72 which meets the open end in flush engagement.

The use of circular conforming mating surfaces together with the locking mechanism prevents powder from being trapped between the two surfaces and also prevents any relative misalignment of these two surfaces regardless of the relative rotational positions of members 10 and 28.

The combined use of elongated and circular openings insures more powder will fall along the major axes than along the minor axes thus providing a relatively uniform distribution of powder onto the tips of the bristles when powder is dispensed. If any powder to be dispensed does not pass through the aligned openings, it will fall ultimately through openings 50 onto the tips and cannot cause impaired operation of the applicator and dispenser.

The use of a plurality of rings and a like plurality of grooves in which the rings are rotatably disposed locks members 10 and 28 into correct position for relative rotation.

It will be apparent to those skilled in the art that member 10 could carry grooves while the recess of memeber 28 could carry rings so that the positions of the members carrying rings and grooves can be reversed. Similarly the surface 22 could be convex rather than concave while the mating surface of region 42 could be concave rather than convex.

What is claimed is:

1. A cosmetic powder dispenser and applicator comprising:

a first elongated hollow member having a first closed end and an open second end, the second end having a centrally disposed curved outer surface of circular shape with a first group of small spaced apart openings therein which communicate with the first member interior;

a hollow elongated capsule adapted to be filled with cosmetic powder, the capsule being closed at one end and open at the other, the capsule being removably slidable into and out of the first member, the capsule, when inserted in the first member, having its open end adjacent the second end of the first member and its closed end closing the first end of the first member;

a second elongated hollow member having a closed third end and an open fourth end, the third end having a centrally disposed curved outer surface of circular shape with a second group of openings and a third group of openings spaced from the curved circular surface;

the second and third groups of openings communicating with the second member interior, the first and second groups of openings each containing like pluralities of like openings;

one of the second and third ends having a recessed outer surface while the other of said second and third ends has a flush outer surface, the said other of the second and third ends extending within the said one of the second and third ends in a connection at which said surfaces are in conforming mating engagement;

one of the first and second members adjacent the correspopnding one of the second and third ends having a plurality of spaced circular rings, the other of said first and second members having adjacent the corresponding other of the second or third ends a like plurality of spaced circular grooves, each groove being engaged rotatably by the corresponding circular ring whereby the either one of the first and second members can be rotated with respect to the other of the first and second members;

the first and second members having a first position of relative rotation at which the openings in the first and second groups are aligned and a second position of relative rotation at which the openings in the first and second groups are out of alignment;

a third elongated hollow member having a fifth open end detachably engaging the fourth end and an oppositely disposed sixth closed end; and a brush having a plurality of essentially parallel bristles with powder applying tips, the brush being disposed in the third member with the tips adjacent the second member and, when the third member is detached from the second member, being manually slidable in the third member back and forth along a line parallel to the direction of elongation of the third member.

2. The dispenser and applicator of claim 1 wherein the bristles in cross section define an elliptically shaped area having major and minor axes, the second group of openings including spaced elongated openings having a common line of elongation aligned with the major axis.

3. The dispenser and applicator of claim 2 wherein the second group of openings includes spaced circular openings aligned with the minor axis.

4. The dispenser and applicator of claim 3 wherein the third group consists only of circular openings.

5. The dispenser and applicator of claim 4 wherein the first and second members have cooperating means for locking the conforming surfaces into mating engagement.

* * * * *